United States Patent [19]

Svoma

[11] Patent Number: 4,802,678

[45] Date of Patent: Feb. 7, 1989

[54] SPORTS RACKET

[76] Inventor: Rodney A. Svoma, 1210 E. Northern, Phoenix, Ariz. 85020

[21] Appl. No.: 825,541

[22] Filed: Feb. 3, 1986

[51] Int. Cl.[4] ..... A63B 51/06

[52] U.S. Cl. ..... 273/73 D; 273/73 C

[58] Field of Search ..... 273/73 R, 73 D, 73 C, 273/29 A, 175

[56] References Cited

U.S. PATENT DOCUMENTS

| | | | |
|---|---|---|---|
| 3,999,756 | 12/1976 | Head | 273/73 C |
| 4,076,241 | 2/1978 | Newsome | 273/73 D |
| 4,168,065 | 9/1979 | Goransson | 273/73 D |
| 4,299,385 | 11/1981 | Boden | 273/73 D |

*Primary Examiner*—Richard C. Pinkham
*Assistant Examiner*—William E. Stoll
*Attorney, Agent, or Firm*—Berthold J. Weis

[57] ABSTRACT

A stringing arrangement for a sports racket which compensates for twisting of the racket in the hand of the user when a ball is hit by areas of the racket to either side of a substantially flat middle region which extends from the heel to the tip of the racket frame. The stringing arrangement presents spaced string areas to opposite faces of the racket from the middle region outwardly to the sides of the racket frame. These spaced string areas become progressively farther from the plane of the substantially flat middle region from said middle region to the sides of the frame.

3 Claims, 1 Drawing Sheet

SPORTS RACKET

TECHNICAL FIELD

This invention is concerned with the construction of hand-held rackets such as those used in the athletic games of tennis and squash.

BACKGROUND OF THE INVENTION

When the player of a game such as tennis strikes the ball with the region of the racket face away from the middle of the racket frame and toward one side edge of the frame the force of the ball reacting on the racket frequently causes the racket to twist about the axis of its handle with the result that the ball is misdirected from the racket in a direction other than that intended by the player.

This phenomenon was recognized by Ernest L. Newsome, an inventor who procured U.S. Pat. No. 4,076,241 on Feb. 28, 1978 for a "Sports Racket" embodying what he perceived to be a solution to the racket twisting problem. Mr. Newsome's solution was to provide two sets of for the racket, with both longitudinal and transverse strings being disposed in pairs and interconnected, or interwoven, to provide sloped faces extending radially outwardly from a central region of the racket face. This stringing arrangement provided a substantially concave ball-engaging surface on each face of the racket head.

Unfortunately, the Newsome stringing arrangement imparts a couple of undesirable characteristics to the racket as well. Balls struck by the Newsome racket along the center line of the racket face and off center toward either the heel or the tip of the frame engage sloping surfaces which redirect the balls even though the balls thus struck have no tendency to twist the face of the racket. Secondly, because the Newsome racket employs twice as many strings as are present in a conventional racket the central flat region of the Newsome racket is much stiffer, with the result that the prized "sweet spot" of the racket is either lost or impaired.

There continues to be a need for a racket construction which will compensate for twisting of the racket caused by mishitting balls and which will not impair the performance of the racket in other respects.

DISCLOSURE OF THE INVENTION

This invention contemplates stringing the racket in a manner to provide a substantially flat interwoven string area in a middle region of the racket frame between the sides of the frame and extending from the heel to the tip of the frame. The strings in the middle region of the racket are substantially the same so far as number and spacing is concerned as those of prior conventional rackets so that the performance of the racket as to balls hit in this region is unimpaired. The stringing arrangement also provides spaced string areas to opposite faces of the racket on both sides of this middle region. The spaced string areas are progressively farther apart from the middle region to the sides of the frame. There are thus provided on each face of the racket sloping areas of string to each side of the elongated, flat middle region. Any balls struck by a region of the racket away from the middle region and toward one side or the other of the frame have a tendency to twist the racket and these balls are redirected by the sloping string areas to compensate for the twisting movement of the racket. Balls struck with the middle region of the racket and which do not twist the racket are not redirected because they strike a flat string area.

BEST MODE FOR CARRYING OUT THE INVENTION

Every tennis player is taught or soon learns on his own the desirability of striking the ball with the center of the racket face, i.e. midway between the sides and the heel and the tip of the racket frame. In this central region appears the so called "sweet spot" on the racket face. It is an area of converging tension where the strings stretch uniformly and the farthest under impact. When the ball is hit with this spot on the racket the ball rebounds cleanly, causing minimal vibration or twisting of the racket. When thus hit the ball most likely leaves the racket on a trajectory most nearly like that which the player intended to impart to the ball.

Many players simply do not have the skill to repeatedly strike the ball with the center of the racket face. If the ball is struck with an area of the racket which is off the longitudinal center line and toward a side edge of the frame of the racket the ball usually is misdirected in its rebound along a trajectory other than that which the player intended. While this phenomenon has been recognized and understood for some time there has yet to be a racket construction or stringing arrangement which would enable the player to reliably overcome this mishitting problem.

Take, for example, the situation in which the player is executing a simple forehand stroke to return the ball. In this stroke the longitudinal axis of the handle of the racket is somewhere near horizontal with the face of the racket nearly normal to the path of the approaching ball or at such an angle thereto as the player estimates will return the ball on the trajectory he desires. Now if the ball is mishit in an area of the racket face, say, which is away from the middle of the racket and toward the uppermost side edge of the racket frame, the impact of the ball against the racket has a tendency to move the upper side edge of the racket frame rearwardly, twisting the racket about the longitudinal axis of its handle. The forces involved are such that even the strongest player with a very tight grip on the racket finds it virtually impossible to resist some twisting of the racket. In the conventional racket with a flat interwoven string area across the entire face of the racket this twisting of the racket results in the ball striking the racket in an angle different from that which had been intended by the player. In the case of a forehand stroke with the ball engaging the upper side edge region of the racket face the ball rebounds in a trajectory that is higher than the player intended. Similarly, if the forehand stroke results in the ball engaging an area of the racket face near the lower side edge of the frame, the twist of the racket results in the ball rebounding with a lower trajectory than had been intended.

Of course, this same phenomenon occurs with other strokes with the twisting of the racket again resulting in the ball rebounding at an angle and into a trajectory other than that intended by the player.

Figure 1:
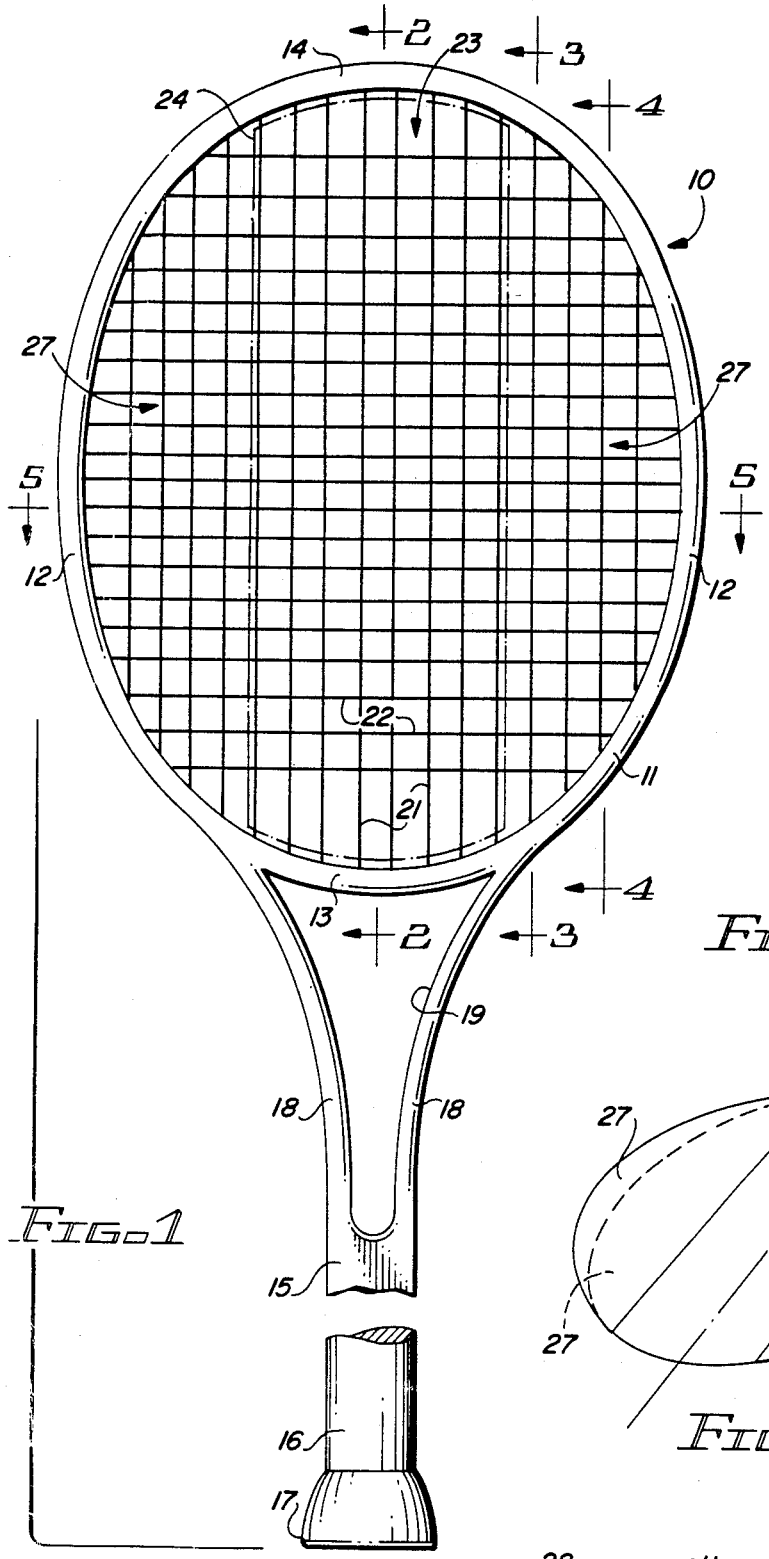
FIG. 1 is a fragmentary view of one face of a sports racket embodying this invention.

A racket construction and stringing arrangement which enables the player to automatically compensate for this racket twisting phenomenon is illustrated in FIG. 1, wherein the reference numeral 10 designates the overall racket. The racket 10 comprises a generally elliptical frame 11 having sides 12 connecting a heel 13 and a tip, or crown, 14. The frame 12 has a handle 15 attached thereto generally in the vicinity of the heel 13. The handle has a grip 16 at the butt 17 thereof and includes a pair of shafts 18 joined to the heel region 13 of the frame and providing an open throat 19.

So far as the present invention is concerned the frame 11 and handle 15 of the racket 10 can be constructed of a variety of materials, such as wood, or metal, or glass, graphite or boron fiber reinforced plastic materials or combinations of these materials. The materials chosen are generally dictated by the degree of flexibility or stiffness which the individual player desires in his or her racket.

This invention is primarily concerned with the stringing arrangement for the racket and the orientation of that arrangement with the frame 11 of the racket. As with conventional rackets, the racket of this invention is strung with a series of longitudinal strings 21 and a series of transverse strings 22. The longitudinal strings are arranged substantially parallel to the axis of the handle 15 of the racket 10 and the transverse strings 22 are arranged generally at right angles to the axis of the handle 15 of the racket 10 and the transverse strings 22 are arranged generally at right angles to the axis of the handle.

Figure 2:
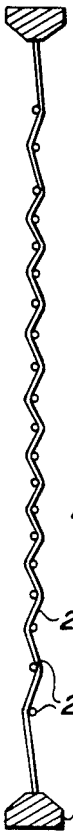
FIG. 2 is a longitudinal sectional view through the head of the racket taken generally as indicated by line 2—2 in FIG. 1.

In a middle region 23 of the racket face within frame 11 the strings 21 and 22 are interwoven and disposed in conventional fashion so as to provide a substantially flat ball striking area on each face of the racket. This middle region 23 extends from the heel 13 to the tip 14 of the frame and occupies a width of approximately 35–45% of the width of the frame from side to side. The confines of middle region 23 are depicted in FIG. 1 by the dot and dash outline 24. This middle region 23 of the frame is strung with spaced single strands of both the longitudinal strings 21 and the transverse strings 22 (see FIG. 2). The number and spacing of strings 21 and 22 in middle region 22 are substantially the same as those of a conventional sports racket so this region of the racket behaves essentially as does a conventional racket so far as its ball rebounding capabilities are concerned. The sweet spot associated with conventional rackets is present in the racket 10 embodying this invention.

Figure 3:
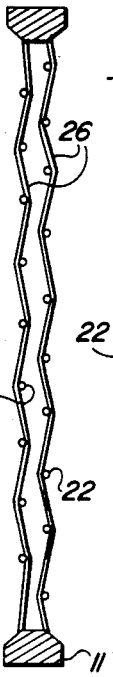
FIG. 3 is a longitudinal sectional view through the racket head taken generally as indicated by the line 3—3 in FIG. 1.
Figure 4:
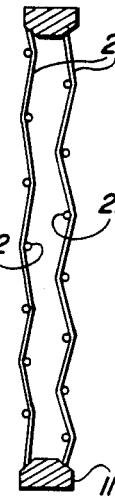
FIG. 4 is a longitudinal sectional view through the racket head taken generally as indicated by the line 4—4 in FIG. 1.
Figure 5:
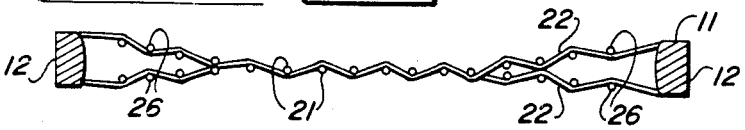
FIG. 5 is a transverse sectional view through the racket head taken generally as indicated by the line 5—5 in FIG. 1.

To either side of the middle region 23 the longitudinal strings 21 of the racket are arranged in pairs 26 (see FIGS. 3–5). The strings 21 in each successive pair of strings 26 from the middle region 23 outwardly to the sides 12 of frame 11 are disposed at greater distances from each other. The disposition of these strings is such as to form to either side of middle region 23 sloping side regions 27 at each face of the racket 10.

Figure 6:
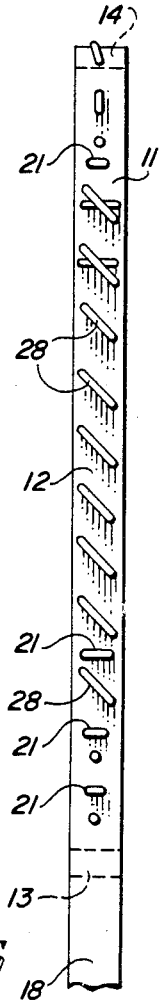
FIG. 6 is a longitudinal edge view of the head of the racket illustrated in FIG. 1; and, FIG. 7 is a diagrammatic, perspective illustration of the ball engaging surfaces provided by the stringing arrangement of this invention.

It is particularly to be noted that the transverse strings 22 are not disposed in pairs but are arranged individually in spaced relationship generally from the heel to the tip of the frame. In order to permit the transverse strings 22 to be interwoven with the longitudinal string pairs 26 and to participate therewith in the formation of the sloping regions 27, the transverse strings 22 are provided with connecting sections 28 (see FIG. 6) which extend diagonally across the outer edges of the frame sides 12. In this manner every other transverse string 21 can be interwoven through one of the strings of the longitudinal string pairs 26 at one face of the racket and the intermediate transverse strings can be interwoven with the other string of the longitudinal string pairs 26. This results in the density of transverse strings 22 in each of the four sloping side regions 27 of the racket head being one-half the density of the transverse strings 22 in the middle region 23 of the head. This string spacing arrangement is a further advantageous feature of this invention as is explained in greater detail hereinafter.

Figure 7:
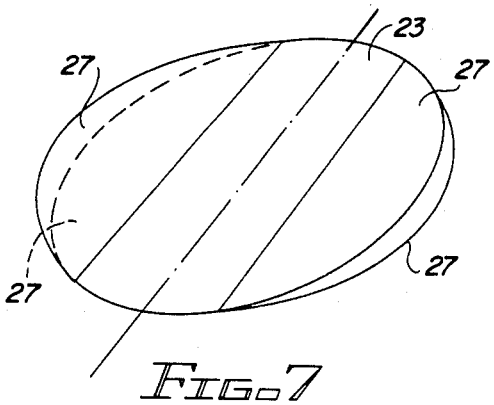

With the stringing arrangement just described there are provided three different ball striking regions within the confines of the racket frame 11 to each face of the racket. There is the single flat middle region 23 extending from the heel 13 to the tip 14 of the frame. Balls struck with this region of the strings have very little tendency to twist the racket in the hands of the player and no correction is imparted to the rebound characteristics of the ball. To either side of middle region 23 for each face of the racket there are provided sloping regions 27 which become farther apart toward the edges 12 of the frame and farther away from the plane of the middle region 23. Balls striking any of the sloping regions 27 have a tendency to twist the racket in the hand of the player and the sloping string area compensates for this twist in the racket to correct the rebound characteristics of the ball. The several ball striking regions of the string area of the racket are illustrated diagramatically in FIG. 7.

Additionally, the lesser density of transverse strings 22 in the sloping areas 27 has the effect of reducing string resistance to ball impact in the sloping areas thereby distributing feel more evenly over the face of the racket and reducing the tendency for balls struck by the sloping areas 27 to cause the racket to twist.

What is claimed is:

1. In a sports racket comprising a frame having sides connecting a tip and a heel, a handle with a grip thereon secured to the heel of the frame, a plurality of longitudinal strings in said frame and extending generally parallel to said handle and a plurality of transverse strings in said frame and extending generally at right angles to said handle, the improvement wherein a plurality of said longitudinal strings in a middle region of said frame have their ends secured to said frame in such a manner that the strings lie generally from the heel to the tip of the frame in a common flat plane coextensive with the plane of said frame, a plurality of said longitudinal strings to either side of said middle region of said frame being provided in pairs with each pair positioned in a plane generally at right angles to said common flat plane, said pairs of longitudinal strings having their ends secured to said frame in such a manner that the distance between the strings in each pair becomes progressively greater and the strings of each pair are farther from said common flat plane from the string pairs adjacent said middle region to the string pairs adjacent the sides of the frame, said transverse strings being positioned individually in spaced relationship generally from the heel to the tip of the frame, every other transverse string being interwoven only with but one of the strings of the pairs of longitudinal strings to either side of said middle region of said frame, the other transverse strings being interwoven only with the other strings of the pairs of longitudinal strings to either side of said middle region of the frame, and each transverse string being separately interwoven with all of the longitudinal strings in said middle region of the frame.

2. In a sports racket comprising a frame having sides connecting a tip and a heel, said frame lying generally in a flat plane and presenting two opposite racket faces, a handle with a grip thereon secured to the heel of the frame, a plurality of longitudinal strings in said frame and extending generally parallel to said handle and a plurality of transverse strings in said frame and extending generally at right angles to said handle, the improvement comprising a stringing arrangement presenting a substantially flat interwoven string area in a middle region of said frame between said sides and extending from the heel to the tip of the frame, and further presenting spaced string areas to opposite faces of the racket on opposite sides of said middle region, said spaced string areas becoming progressively farther apart from said middle region to the sides of the frame whereby there are provided for each face of the racket string areas on opposite sides of said middle region which are sloping with respect to the plane of the frame and extend from said middle region to the sides of the frame, said string area in said middle region of said frame being composed of spaced single strands of both longitudinal and transverse strings and the number of transverse strings presented in the string areas to opposite faces of the racket and on opposite sides of said middle region is approximately one half the number of transverse strings presented in the string area in the middle region of said frame.

3. The sports racket of claim 2 wherein the string area in said middle region of the frame occupies about 35 percent to about 45 percent of the maximum distance between the sides of said frame.

* * * * *